US005148696A

United States Patent [19]

Visscher

[11] Patent Number: 5,148,696

[45] Date of Patent: Sep. 22, 1992

[54] METAL FORMING AND DRAWING PROCESS AND APPARATUS

[75] Inventor: Paul R. Visscher, Saugatuck, Mich.

[73] Assignee: Spectta Products Corporation, Grand Haven, Mich.

[21] Appl. No.: 737,212

[22] Filed: Jul. 29, 1991

Related U.S. Application Data

[63] Continuation of Ser. No. 557,594, Jul. 25, 1990, abandoned.

[51] Int. Cl.[5] ..... B21D 22/26

[52] U.S. Cl. ..... 72/348; 72/347

[58] Field of Search ..... 72/308, 309, 347, 348, 72/349, 350, 351, 379.4, 462

[56] References Cited

U.S. PATENT DOCUMENTS

| | | | |
|---|---|---|---|
| 1,944,527 | 1/1934 | Pfaendler | 72/348 |
| 3,314,275 | 4/1967 | Mullen | 72/350 |
| 4,833,903 | 5/1989 | de Smet | 72/350 |

FOREIGN PATENT DOCUMENTS

| | | | |
|---|---|---|---|
| 110770 | 5/1986 | Japan | 72/462 |
| 154224 | 6/1988 | Japan | 72/349 |
| 170526 | 7/1989 | Japan | 72/347 |

*Primary Examiner*—Lowell A. Larson

*Attorney, Agent, or Firm*—Price, Heneveld, Cooper, DeWitt & Litton

[57] ABSTRACT

A process for manufacturing an integral metal furniture top having formed and drawn sides and connecting drawn corners in a single step. Each connecting corner has a radius of approximately 3/32 inch. A segmented die is employed having surface treated steel corner pieces with working faces at an approximately 90° angle and steel side pieces having a compound working face including a metal forming face and a trailing coining projection for substantially removing the shockline produced during the forming operation. A metal blank has metal cut out of each corner that would interfere with the drawing process. The metal blank is placed on a mandrel and surrounding pressure plate. The segmented die then closes on the metal blank forming the sides and drawing the corners of the furniture top in a single operation. The sheet metal used to form the top is approximately 0.028 to 0.031 inch thick and to die/mandrel clearance is approximately 0.032 to 0.033 inch. The furniture top and segmented die are also disclosed.

4 Claims, 2 Drawing Sheets

METAL FORMING AND DRAWING PROCESS AND APPARATUS

This is a continuation of application Ser. No. 07/557,594, filed Jul. 25, 1990, abandoned.

BACKGROUND OF THE INVENTION

In the forming of metal tops for furniture pieces such as tables and, more commonly, cabinets such as filing cabinets, it has been common practice to put a metal blank into a press and to then bend down the edges to form the sides for the top. The edges would then be joined by welding to form the corners which would then be ground to remove the traces of the weld and to shape the corner. The manufacturing of tops by this procedure was very labor intensive and was also subject to a high scrap rate due to the difficulty in welding and grinding of the thin metal corners. The metal would often be burned in the welding process and/or crack in the grinding process and, even more frustrating, an apparently acceptable top would, after painting and being installed on a piece of furniture, crack in shipment to a customer due to the vibration produced in the moving process. The product would arrive at the customer having one or more cracked corners on the furniture top and would be unacceptable, potentially causing bad will with the customer.

Furniture tops have also been prepared using a combined bending and drawing operation. However, the corners of the drawn tops had to be rounded because of the stresses involved in the drawing process. Tops prepared in this manner were only suitable for special applications where rounded corners could be tolerated. They could not be used on cabinets and particularly file cabinets where sharp corners are needed in order to allow the cabinets to be butted together into a substantially unbroken line.

Conventional wisdom in the stamping industry dictates that in order to make drawn steel parts, certain restrictions related to radius of corners and depth of draw must apply. Deeper draws and smaller radii beyond these limits would require secondary draws and auxiliary operations, respectively. Also, imperfections such as shocklines created by the draw process are unavoidable and must be tolerated.

The formation of corners for metal tops by drawing has been long desired in the metal furniture industry. The progress in this field has been substantially limited by the inability to draw the metal far enough to make acceptable corners. As a result of considerable effort, a "rule-of-thumb" for a single stage draw was accepted that one could not draw metal longer than eight times its thickness. For example, a 0.031 inch thick piece of metal could only be drawn 0.250 inch which was too short for use in a furniture top.

SUMMARY OF THE INVENTION

In accordance with the present invention, a process has been developed for manufacturing single piece metal furniture tops in which the side portions are formed and drawn and connected to drawn corner portions in a single operation. The corner portions having a radius of approximately 3/32 inch and appear similar to folded, welded and ground corners, however, without all of the labor involved in the preparation of such corners and the potential for damage to the top. Also, the metal is drawn substantially further than expected by the previously mentioned "rule-of-thumb." In a representative furniture top, the corner is drawn 1½ inches in a single draw.

A segmented die is used in the manufacturing process which has hardened, smooth steel corner pieces joined to side pieces which have a combined or compound working face including a metal forming and drawing face and a coining face. The coining face is used to remove the shockline which appears during the forming process. The shockline is substantially removed in the same process that created it. The coining projection on the side forming faces compress or flatten the metal from the shockline into the drawn and formed side of the furniture top. The die and mandrel clearance used in the drawing and forming process are considerably less than previously thought possible.

DETAILED DESCRIPTION OF THE PREFERRED EMBODIMENTS

Figure 1:
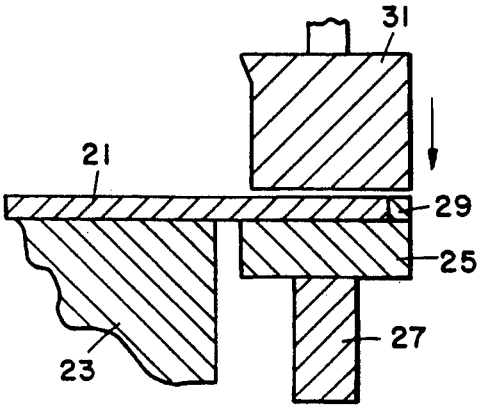
FIG. 1 is a schematic elevational view partially in section showing a metal forming die approaching a metal workpiece which is supported on a punch in a movable pressure plate.

Referring to FIG. 1, the metal blank or workpiece 21 is shown resting upon a punch or mandrel 23 and upon the top surface of a pressure plate 25 which is supported by a closed nitrogen cylinder 27. A metal standoff 29 is provided on the pressure plate to limit the pressure that can be exerted on the metal by the die 31 as it comes down, as shown by the directional arrow, to grip the metal workpiece. The die piece 31 corresponds to a side piece of the segmented die shown in FIGS. 7 and 8.

Figure 7:
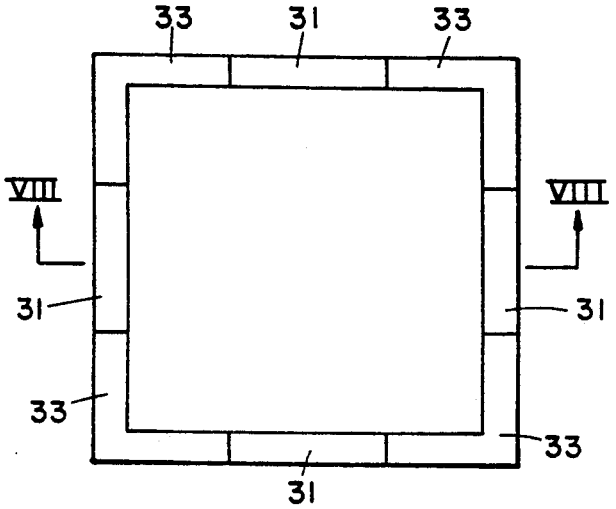
FIG. 7 is plan view of the segmented die used in the preparation of the furniture top.
Figure 8:
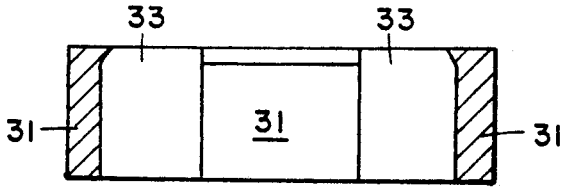
FIG. 8 is a sectional view along the line VIII—VIII of FIG. 7.

Now referring to FIGS. 7 and 8, the segmented die used in the process of the present invention to manufacture the integral furniture top has four side pieces 31 and four corner pieces or corner steels 33. The corner pieces 33 are made out of tool steel, preferably a D2-type tool steel which, after shaping to form the 90 corner, has been given a conventional surface treatment to substantially harden the working faces on the corner piece and to provide an extremely smooth surface. The preferred surface treatment is titanium nitride. The corner pieces have four working faces with the two bottom faces and the two side faces being joined along common lines The bottom faces are used to grip the metal workpiece and to releasably hold it during the drawing process. The side working faces are used to hold the workpiece against the sides of the punch at the corner of the punch during the drawing process.

Figure 3:
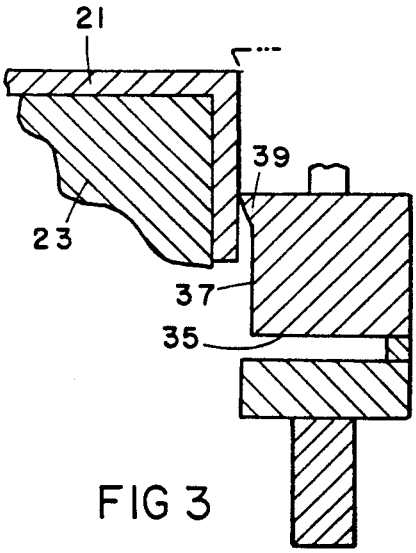
FIG. 3 is a schematic elevational view partially in section showing the metal workpiece being shaped by the coining working face on the die.

The side pieces of the segmented die, as shown in FIG. 3, have a bottom working face 35 for releasably holding the metal workpiece 21 during the drawing and forming operation and a compound or composite work face 37 which is used to press the workpiece against the metal punch 23 during the forming and drawing operation and a joined coining work face 39 which is used to substantially remove the shockline 41 which arises along the edge of the metal piece during the forming operation.

Shockline is a phenomenon which occurs on the vertical surface of a tapered draw. The line is visible and can be felt as a small ridge in the material. It is created by the difference in the flow of the material as it is drawn. One portion of the material is bent down while the remaining portion flows over the draw radius. Present state of the art indicates that it cannot be eliminated.

Figure 4:
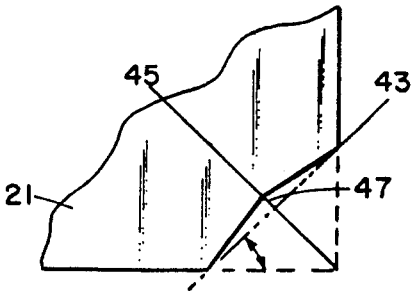
FIG. 4 is a plan view partially in section showing how the metal edge of the workpiece is cut back prior to drawing.

In the preparation of a metal furniture top, in accordance with the present invention (FIG. 4), a portion of the corner of workpiece 21 is removed to limit the amount of metal in the corner area which is to be drawn. If too much metal is present in the corner area, it has a tendency to gather or bunch up during the drawing process and to then tear away, destroying the corner. By limiting the amount of metal in the corner prior to the draw, the drawing process can be carried out without having the tearing problem The amount of metal to be removed is determined by the depth of the draw to be made. As shown in FIG. 4, a line 43 is marked at a 45° angle across the corner portion. A pair of lines are then drawn from the edge of the workpiece where it intersects the line 43 to a line 45 bisecting the corner of the workpiece. The setback 47 between the line 43 and the two lines meeting at line 45 can be determined experimentally by drawing sample furniture tops. It has been found for a draw of approximately 1½ inches that a setback of approximately 0.2 inch and preferably 0.188 inch will result in the proper amount of metal being removed from the corner prior to the drawing operation. The metal is removed from each of the corners of the furniture top prior to the drawing and forming operation After the metal blank has been prepared, it is then placed into a press for drawing and forming.

The press used in the drawing and forming process should preferably be of the hydraulic type, although a mechanical press has also been found to be satisfactory. The press, as is usual in drawing operations, should move at a relatively slow rate to allow the metal to be formed and drawn without undue thinning or tearing. The rate of movement of the press is the same as that used in drawing and forming metal.

A lubricant should be used in the drawing and forming process which has substantial body or viscosity. Many commercially available drawing lubricants are available. If the metal being shaped has a textured finish, it is preferred to use a pigmented paste-type lubricant to help protect the textured finish of the metal. The pigmented filler material is not necessary if smooth or untextured metal is being drawn and formed.

For forming the top of a piece of furniture, the metal used is preferably from approximately 0.028 to 0.031 inch in thickness. This is commonly available steel. Since a drawing process is to be carried out, a steel with a high modulus of elasticity is used. A DQSK steel is preferred for use in the process. A DDQ steel can also be used; however, the increased expense is not necessary for the production of furniture tops according to the process of the present invention.

Figure 2:
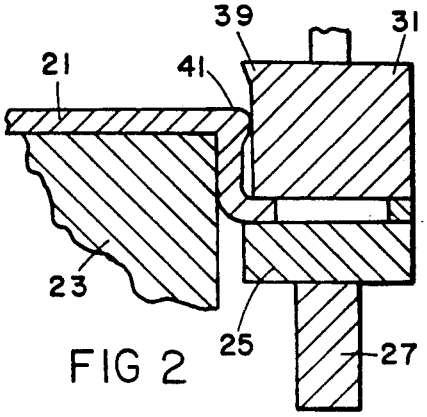
FIG. 2 is a schematic elevational view partially in section showing the metal workpiece undergoing drawing and forming.

After the corners of the metal are cut away, as shown and described in relation to FIG. 4, the metal blank is inserted into the press and is positioned on the punch 23 and pressure plate 25 adjacent the stand-off 29 (FIG. 1). Lubricant is applied to the metal blank and the press is actuated causing die 31 to contact the stand-off 29 gripping the metal. The pressure plate moves downwardly (FIG. 2) under the pressure of the die and compresses nitrogen cylinder 27. As die 31 moves down, referring to FIG. 2, metal 21 bends along the edge of punch 23 and develops a shockline 41. A shockline characteristically results when a metal piece is subjected to a draw forming treatment. Die 31 continues downwardly against pressure plate 25 and the end of metal piece 21 slowly escapes from between the gripping surfaces. The coining portion of die 49 then contacts shockline 41 and draws the metal from the shockline downwardly in a sliding coining operation, as shown in FIG. 3, into the metal of the depending edge of the furniture top (FIG. 2).

Figure 5:
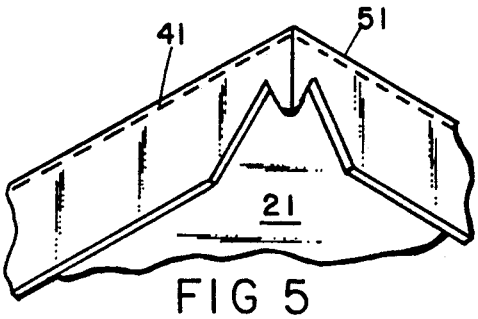
FIG. 5 is a partial perspective view showing the drawn corner of the furniture top.
Figure 6:
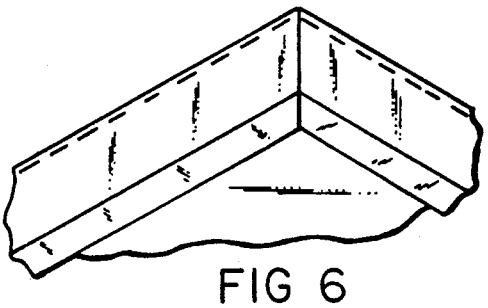
FIG. 6 is a partial perspective view showing the metal corner after the metal has been folded to complete the furniture top.

The corners of the metal blank are contacted by corner pieces 33 which, as previously described, are very hard and smooth. The corner portion does not develop a shockline as the metal is drawn through such a tight or narrow area between punch 23 and corner piece 33, that the material in the corner of the furniture top is substantially flattened and urged toward the corner where the metal had previously been cut away. As mentioned above, metal 21 is preferably in the range of 0.028 to 0.031 inch in thickness. The die clearance from metal punch 23 is preferably 0.032 to 0.033 inch. In view of the very close tolerance of the die and punch, the metal is drawn considerably further than previously thought possible. After the forming and drawing process (FIG. 5), workpiece 21 is removed from punch 23. Shockline 41 has substantially disappeared from the edge portions of the furniture top and, as discussed above, the excess metal from the corner portion is forced into a projecting portion 51 which is trimmed before folding and finishing of the part.

It is believed that the square corner allows more material to gather at the intersection, providing the extra steel needed to increase the draw depth. Measured cross-sections of corners have shown this to be true.

It is also believed that the die clearance that has been established (0.001 to 0.004) creates a situation where the compressive and circumferential material flow is so restricted and directed into the corner that it subtracts from the tensile flow stresses and limits tensile tear.

Figure 9:
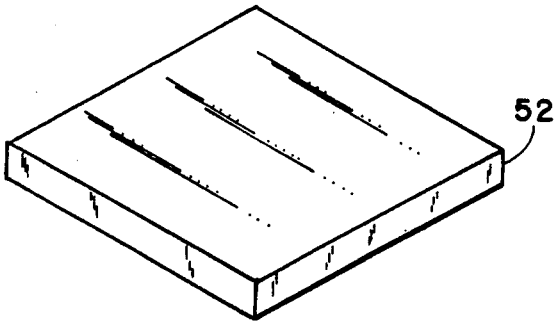
FIG. 9 is a perspective view showing the top and side surfaces of a finished furniture top.
Figure 10:
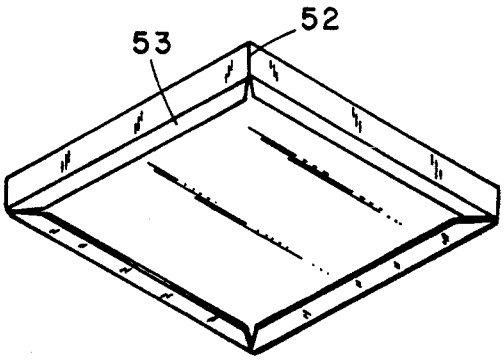
FIG. 10 is a perspective view of the bottom of a finished furniture top.

In FIGS. 9 and 10, a finished furniture top is shown. The corners 52 of the top are drawn at approximately a 90° angle and substantially further than previously thought possible for this thickness metal. Each corner edge is approximately 1½ inches long. On examination of several tops, it has been found that the sides of the corner are approximately ½ away from a 90° bend. As shown in FIG. 10, the lower portion of each depending side has been folded over to form a flat bordering surface 53 about the bottom of the furniture top. The edges of the bottom portion are substantially closed at each drawn corner 52 forming a completed furniture top without the need for welding or grinding to finish the corner. Also, if the metal of the furniture top is textured, the finish will remain being only slightly disturbed in the extreme corner portions. The slight change in the texture all but disappears in the final painting of the furniture top.

Though the invention has been described with respect to a specific preferred embodiment thereof, many variations and modifications will become apparent to those skilled in the art. It is therefore the intention that the appended claims be interpreted as broadly as possible in view of the prior art to include all such variations and modifications.

The embodiments of the invention in which an exclusive property or privilege is claimed are defined as follows.

1. A method for preparing a metal furniture top having a surface and side portions joined together by drawn corners having a radius of approximately 3/32 inch comprising the following steps:

providing a metal blank;

trimming metal from each corner of said metal blank where the corner is to be drawn joining said surface and said side portions to limit the amount of metal to be drawn in drawing said corner, each corner being trimmed backward, prior to drawing, from a line at an angle to each side plus an additional amount from a portion near the center of said line on a line substantially bisecting said corner, said additional amount being determined by the depth of the draw;

placing said metal blank on a punch in a press;

providing a segmented metal die having corner pieces and side pieces in said press;

closing said press to bring said die and said punch to bear on said metal blank to form and draw said side portions and to draw said connecting corner portions in a single operation; and removing any excess metal from said drawn corners and finishing said metal furniture top.

2. The method of claim 1 wherein each corner is trimmed backward from a line at a 45° angle to each side plus an additional amount from a portion near the center of said line on a line substantially bisecting said corner, said additional amount being determined by the depth of the draw.

3. The method of claim 1 wherein the clearance of said metal die from said metal blank in the forming and drawing operation is approximately 0.001 to 0.004 inch.

4. The method of claim 1 in which the metal blank is approximately 0.028 to 0.031 inch thick and the die clearance from said punch is approximately 0.032 to 0.033 inch.

* * * * *

UNITED STATES PATENT AND TRADEMARK OFFICE

CERTIFICATE OF CORRECTION

PATENT NO. : 5,148,696

DATED : September 22, 1992

INVENTOR(S) : Paul R. Visscher

It is certified that error appears in the above-identified patent and that said Letters Patent is hereby corrected as shown below:

column 2, line 62: "90 corner" should be --90° corner--;

column 2, line 68: after "lines" insert --.--;

column 3, line 33: after "problem" insert --.--;

column 3, line 48: after "operation" insert --.--;

column 4, line 62: "1/2 away" should be --1/2° away--.

Signed and Sealed this

Twenty-fifth Day of January, 1994

*Attest:*

Bruce Lehman

BRUCE LEHMAN

*Attesting Officer*

*Commissioner of Patents and Trademarks*